US009112258B1

(12) United States Patent
Church et al.

(10) Patent No.: US 9,112,258 B1
(45) Date of Patent: Aug. 18, 2015

(54) ELECTRICALLY SMALL CIRCULARLY POLARIZED ANTENNA

(75) Inventors: Justin A. Church, San Diego, CA (US); John H. Meloling, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 486 days.

(21) Appl. No.: 13/494,111

(22) Filed: Jun. 12, 2012

(51) Int. Cl.
*H01Q 7/00* (2006.01)
*H01Q 21/26* (2006.01)

(52) U.S. Cl.
CPC ..... *H01Q 7/005* (2013.01); *H01Q 21/26* (2013.01)

(58) Field of Classification Search
CPC ..... H01Q 7/00; H01Q 7/005; H01Q 19/00; H01Q 21/26
USPC ..... 343/726, 728, 741, 742, 744, 797, 833, 343/834
See application file for complete search history.

(56) References Cited

U.S. PATENT DOCUMENTS

| | | | | |
|---|---|---|---|---|
| 3,605,104 | A * | 9/1971 | Weston et al. | 343/837 |
| 7,187,336 | B2 * | 3/2007 | Parsche | 343/728 |
| 7,692,601 | B2 * | 4/2010 | Bisiules et al. | 343/803 |
| 7,969,373 | B2 * | 6/2011 | Tsilioukas et al. | 343/744 |
| 8,723,731 | B2 * | 5/2014 | Tatarnikov et al. | 343/700 MS |
| 2009/0140946 | A1 | 6/2009 | Ziolkowski | |

OTHER PUBLICATIONS

Chia-Ching Lin, Peng Jin, and Richard W. Ziolkowski, Fellow, IEEE; "Multi-Functional, Magnetically-Coupled, Electrically Small, Near-Field Resonant Parasitic Wire Antennas"; IEEE Transactions on Antennas and Propagation, vol. 59, No. 3, Mar. 2011.

Ziolkowski, R.W.; Peng, Jin; Chia-Ching, Lin; "Metamaterial-inspired, multi-functional, near-field resonant parasitic antennas," 2010 IEEE International Conference on Wireless Information Technology and Systems, pp. 1-4.

Ziolkowski, R.W.; Peng, Jin; Chia-Ching, Lin; "Multi-functional, electrically small, metamaterial-inspired, near-field resonant parasitic antennas," 2010 Conference Proceedings on ICECom, pp. 1-4.

Peng, Jin; Chia-Ching, Lin; Ziolkowski, R.W.; "Multi-band linear and circular polarized, electrically small, near field resonant parasitic antennas", 2010 International Workshop on Antenna Technology, pp. 1-4.

D. Sievenpiper, D. Dawson, M. Jacob, T. Kanar, S. Kim, J. Long, R. Quarfoth, "Experimental Validation of Performance Limits and Design Guidelines for Small Antennas", IEEE Transactions on Antennas and Propagation, vol. 60, No. 1, pp. 8-19, Jan. 2012.

* cited by examiner

*Primary Examiner* — Michael C Wimer
(74) *Attorney, Agent, or Firm* — SPAWAR Systems Center Pacific; Kyle Eppele; J. Eric Anderson

(57) ABSTRACT

An efficient electrically small circularly polarized SATCOM antenna includes two crossed half loops which are encapsulated by a capacitive cage structure which acts as an internal matching network for the antenna. The cage structure induces two orthogonal electric fields which are 90 degrees out of phase, which produces omni-directional circularly polarized radiation patterns. The gain and impedance performance surpasses that of prior art of similar size.

15 Claims, 13 Drawing Sheets

Copper Half Loops with Dimensions (cage removed)

Top Down view

Bottom Up view

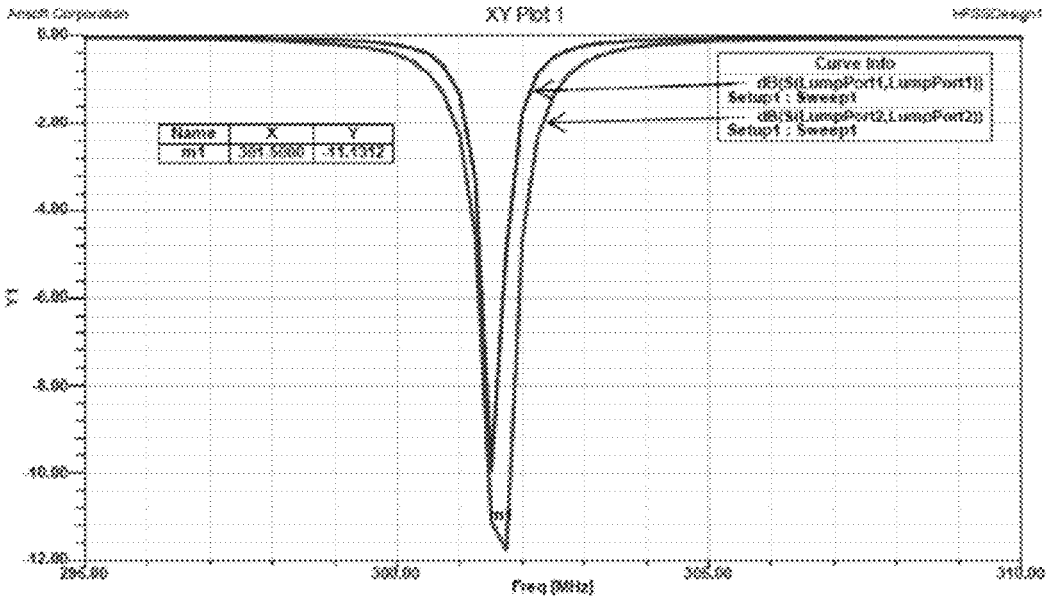
Return Loss seen at each RF Port (S11 and S22 in dB) as a function of frequency (MHz)
FIGURE 8
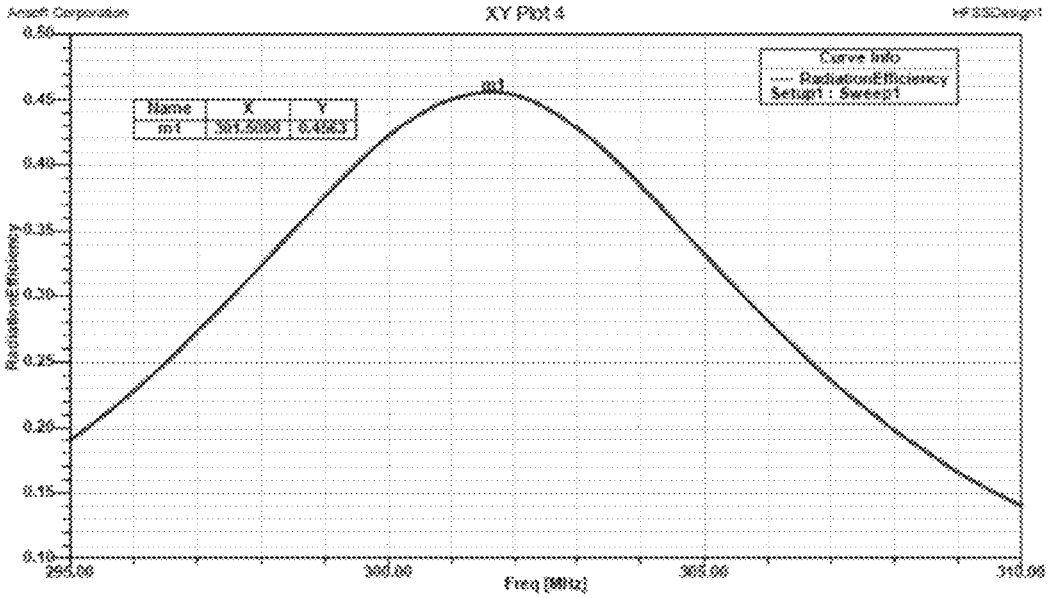
Radiation Efficency of Antenna as a function of frequency (MHz) FIGURE 9

3-D Radiation Pattern of Right Hand Circular polarization Pattern at 301.5 MHz (in dB)

Right Hand and Left Hand Circular Polarization (in dB) at Theta=0deg, Phi=0deg as a function of frequency (MHz) FIGURE 11

Polar Plot of Right Hand and Left Hand Circular Polarization (in dB) at 301.5MHz

ELECTRICALLY SMALL CIRCULARLY POLARIZED ANTENNA

FEDERALLY-SPONSORED RESEARCH AND DEVELOPMENT

This invention (Navy Case NC 101,173) is assigned to the United States Government and is available for licensing for commercial purposes. Licensing and technical inquiries may be directed to the Office of Research and Technical Applications, Space and Naval Warfare Systems Center, Pacific, Code 72120, San Diego, Calif., 92152; voice (619) 553-2778; email T2@spawar.navy.mil.

BACKGROUND OF THE INVENTION

In one preferred embodiment, the present invention provides a very compact, low profile, electrically small, efficient antenna capable of producing circularly polarized radiation patterns for the satellite communication (SATCOM) frequencies (250-300 MHz).

The major engineering problem addressed is that the present invention provides sufficiently large right hand circularly polarized (RCP) gain of −0.880 dBi at the UHF frequency of 300 MHz. A RCP gain near −0.8 dBi at this frequency is quite challenging to achieve with electrically small antennas. In addition, this design is very low profile, as it maximum height is 15 mm, and a maximum width of 85.5 $mm^2$, which results in a very electrically small (ka=0.38) circularly polarized antenna.

One previous approach is an antenna design with the same resonant frequency of 300 MHz. While that previous design operates at the same frequency as the present invention, that prior design does not provide circularly polarized radiation patterns which are critical for SATCOM communications. In addition, that prior design is much larger in physical dimensions, with a maximum height of 66.4 mm, and maximum width of 132.8 mm. These dimensions translate to an electrical dimension of (ka=0.43). This physical size is much too large for many portable applications, such as in the Navy and other applications which require portability.

Another previous design has an operational frequency of 1.5754 GHz, with a corresponding electrical size of (ka=0.495). While that previous design is capable of producing circularly polarized radiation patterns, if the physical dimensions were rescaled to work at an operational frequency of 300 MHz, the maximum dimension in width would result in 157.56 mm, with a maximum height of 78.78 mm. These dimensions again, are much too large for many portable applications in the Navy, and other applications which require portability.

SUMMARY OF THE INVENTION

In one preferred embodiment, the present invention provides an electrically small circularly polarized antenna comprising a ground plane, first and second electrically conductive half-loop rings located at the center of the ground plane, wherein the first and second rings are orthogonally crossed relative to each other. An RF power source feeds RF power to each of the crossed rings having a 90 degree phase difference relative to each other such that the crossed rings create orthogonal electric fields relative to each other resulting in a circularly polarized total electric field. An impedance matching circular electrically conductive cage structure is located surrounding the crossed rings to allow electric current to circulate around the perimeter of the cage structure.

BRIEF DESCRIPTION OF THE DRAWINGS

The invention will be more fully described in connection with the annexed drawings, where like reference numerals designate like components, in which:

FIG. 8 shows return loss seen at each RF Port (S11 and S22 in dB) as a function of frequency (MHz).

FIG. 9 shows radiation efficiency of antenna as a function of frequency (MHz).

DETAILED DESCRIPTION OF THE PREFERRED EMBODIMENTS

In one preferred embodiment, the present invention provides a very compact, low profile, electrically small, efficient antenna capable of producing circularly polarized radiation patterns for the satellite communication (SATCOM) frequencies (250-300 MHz). However, the aspects of the present invention could be scaled for higher frequencies, as will become apparent.

In one preferred embodiment, the present invention provides sufficiently large right hand circularly polarized (RCP) gain of −0.880 dBi at the UHF frequency of 300 MHz. A RCP gain near −0.8 dBi at this frequency is quite challenging to achieve with electrically small antennas. In addition, this design is very low profile, as it maximum height is 15 mm, and a maximum width of 85.5 $mm^2$, which results in a very electrically small ka coefficient (ka=0.38) circularly polarized antenna.

Figure 1:
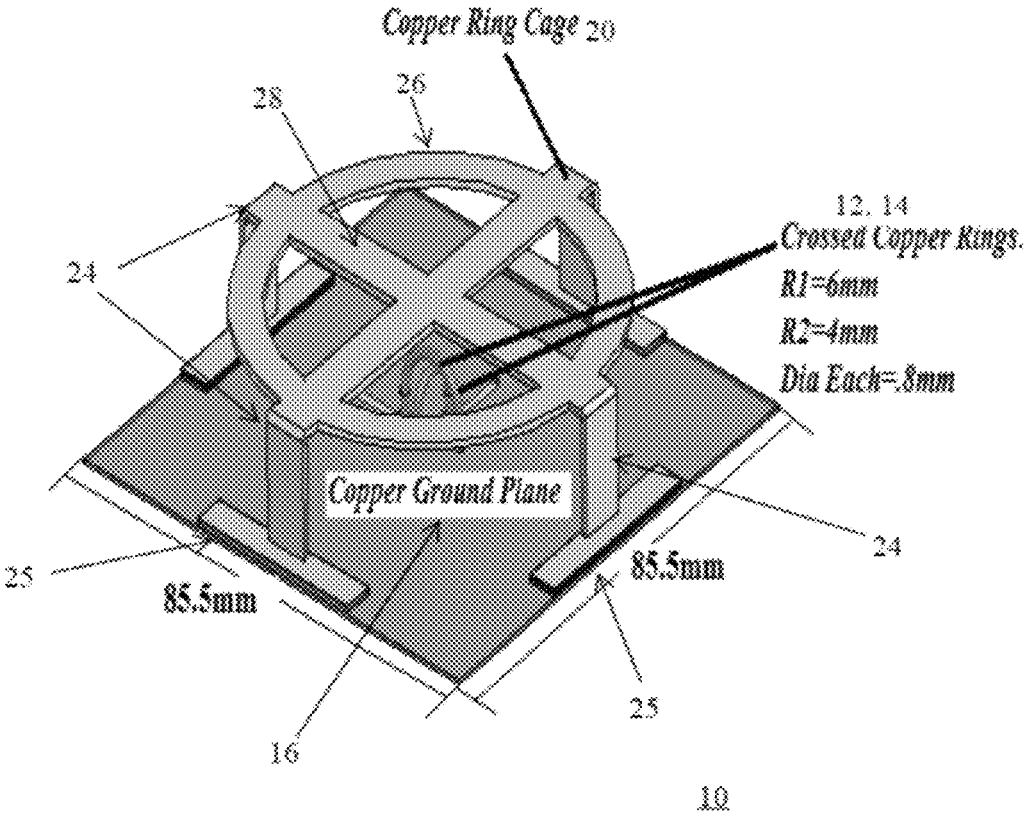
FIG. 1 shows a profile view of one preferred embodiment of the present invention.
Figure 2:
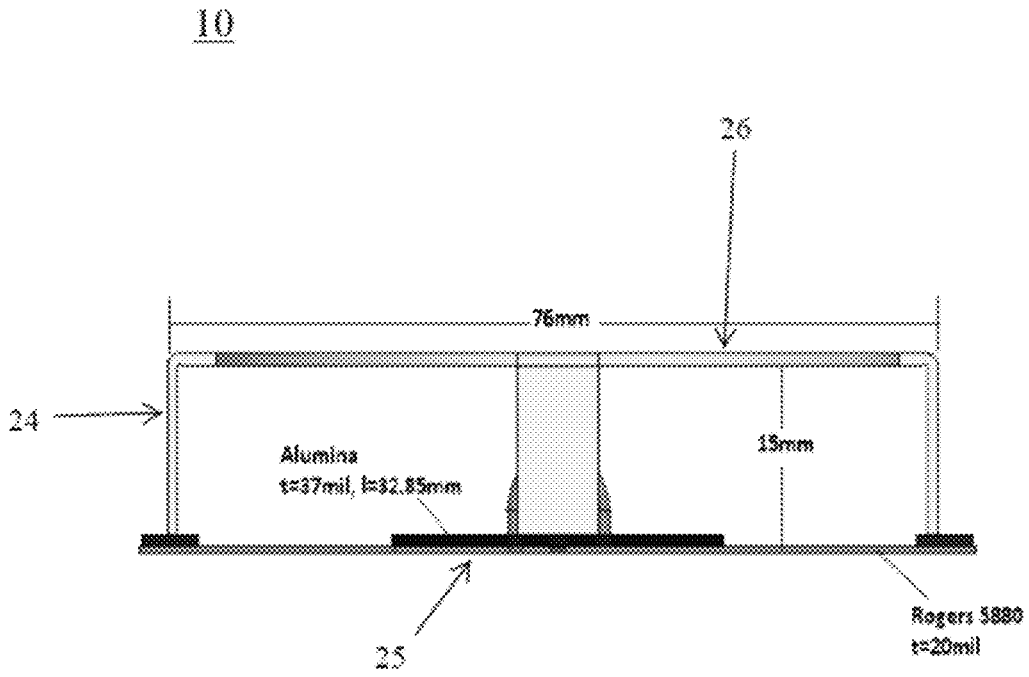
FIG. 2 shows a side view of the embodiment of FIG. 1.
Figure 3:
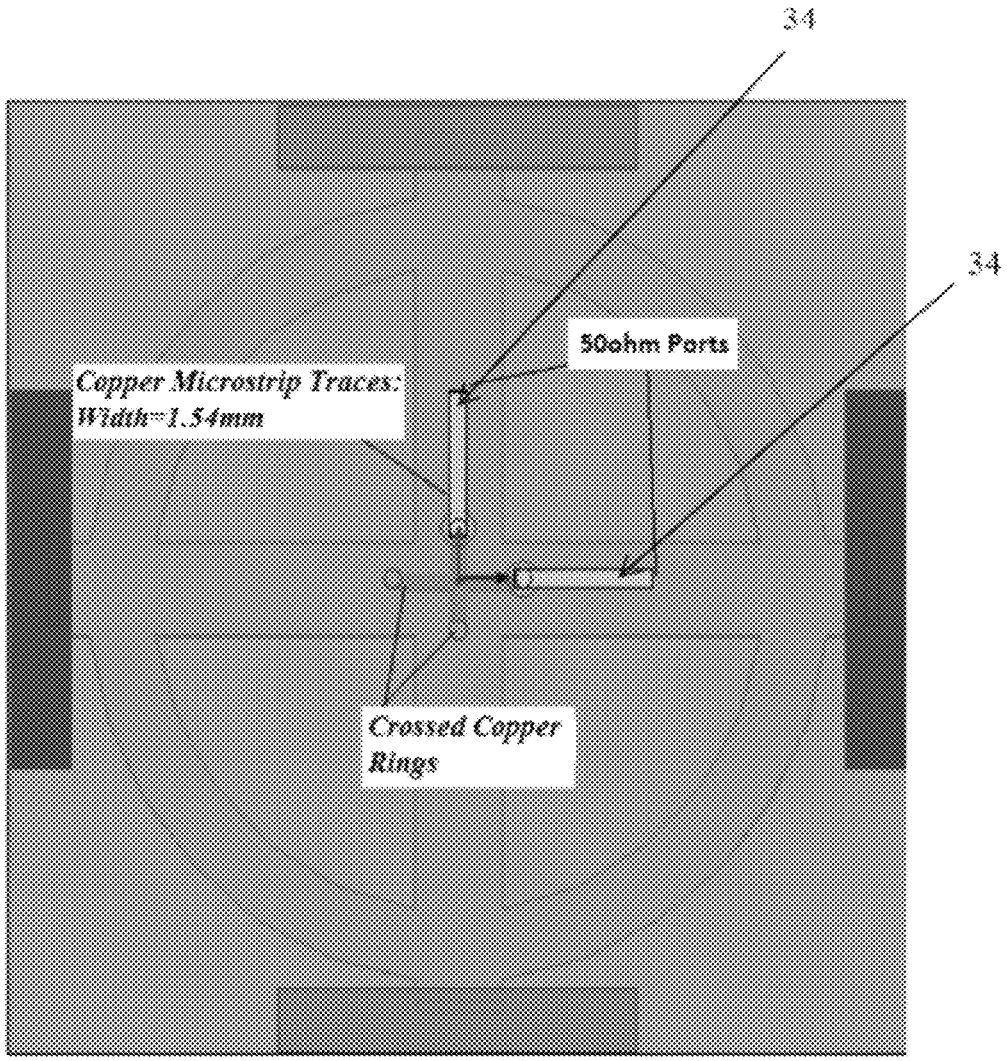
FIG. 3 shows a bottom view of the embodiment of FIG. 1.

FIG. 1 shows a profile view of one preferred embodiment 10 of the present invention, FIG. 2 shows a side view of the embodiment of FIG. 1, and FIG. 3 shows a bottom view of the embodiment of FIG. 1.

This invention includes two crossed half loop copper rings 12, 14, located at the center of the device. Each copper ring 12, 14 is fed with an RF power source (RF1, RF2 in FIG. 5), with a 90 degree phase difference between the two. The two rings 12, 14 create orthogonal electric fields, or magnetic dipole moments, resulting in the creation of a circular polarized total field.

Surrounding the rings 12, 14 is a copper cage structure 20, including four legs 24 resting (e.g., bonded) on top of alumina dielectric slabs 25 of 37 mil in thickness, which in turn are on top of a copper ground plane 16. As is known, a ground plane is a generally flat or nearly flat horizontal conducting surface that serves as part of an antenna for reflection purposes.

The four legs 24 rest on the dielectric slabs 25, as shown in FIG. 1 and more clearly in FIG. 2. Connecting all four legs 24 is a copper ring 26, which is 34 mm in radius, which allows current to circulate around the perimeter of the device 10. A copper cross 28 in located in the center of ring 26.

The purpose of the copper cage structure 20 is to impedance match the antenna at its input by creating capacitive fields near the inductive fields generated by the copper rings, to which the combination of inductive and capacitive fields cancel, allowing for efficient radiation of the device given its small electrical size.

Illustrative dimensions of the antenna 10 shown in FIG. 1 are as follows: The radius of ring 12 is 6 mm; the radius of ring 14 is 4 mm; the diameter of each ring 12, 14 is 0.8 mm; the width of each side of the square ground plane is 85.5 mm.

Illustrative dimensions of the side view of the device 10 shown in FIG. 2 are as follows: the vertical height is 15 mm; the thickness of the alumina dielectric slabs is 37 mil, with a length of 32.85 mm; and the diameter across the ring 26 is 76 mm.

Figure 5:
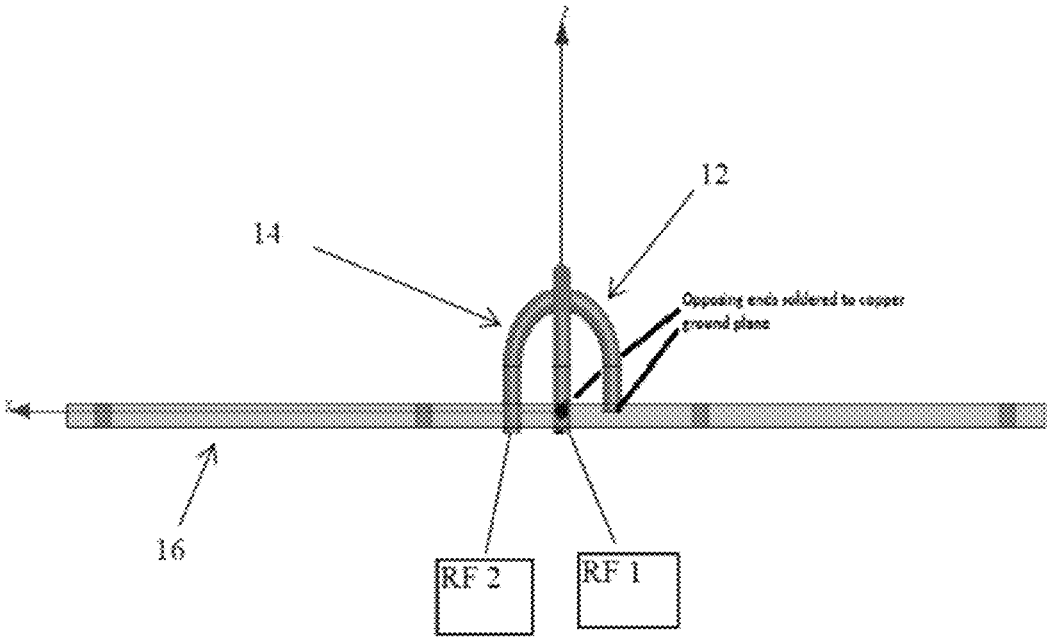
FIG. 5 shows a side view of copper half loops (cage removed).

The bottom view of the device 10 shown in FIG. 3 includes copper microstrip traces 34, each of which have a width of 1.54 mm and a 50 ohm port for connection to a respective RF source (shown in FIG. 5).

Figure 4:
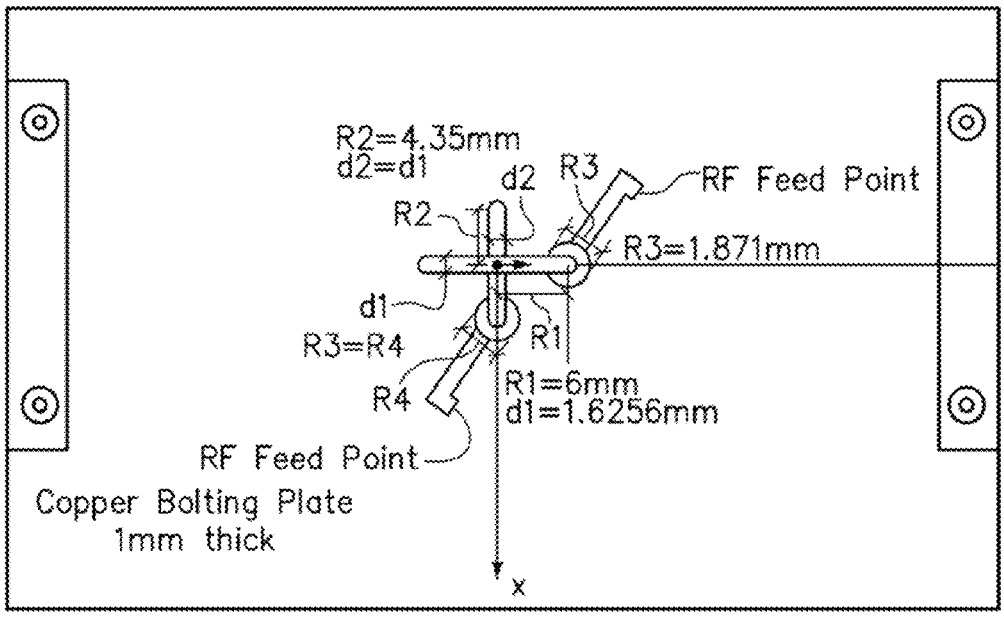
FIG. 4 shows a view of copper half loops with dimensions (cage removed).

FIG. 4 shows a view of copper half loops with illustrative dimensions (cage structure removed). The illustrative dimensions are as follows: R1=6 mm, with d1=1.6256 mm; R2=4.35 mm, with d2=d1; R3=1.871 mm, and R3=R4. The copper ground plane has a thickness of 1 mm.

FIG. 5 shows a side view of copper half loops 12, 14 (cage structure removed) for the antenna 10. In FIG. 5, the opposing ends of loops 12, 14 are soldered to ground plane 16, and RF power sources RF1, RF2 are inputs to the 50 ohm ports shown in FIG. 3.

Figure 6:
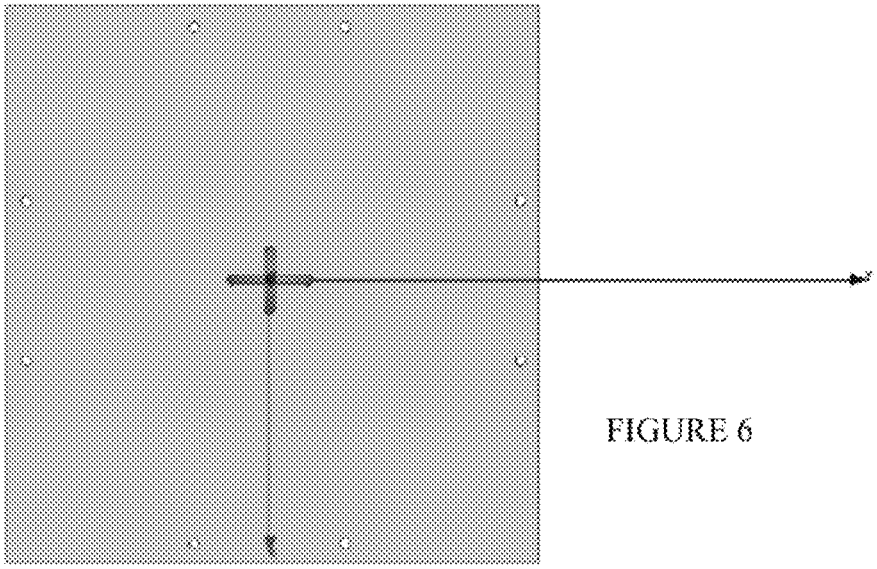
FIG. 6 shows a top down view.
Figure 7:
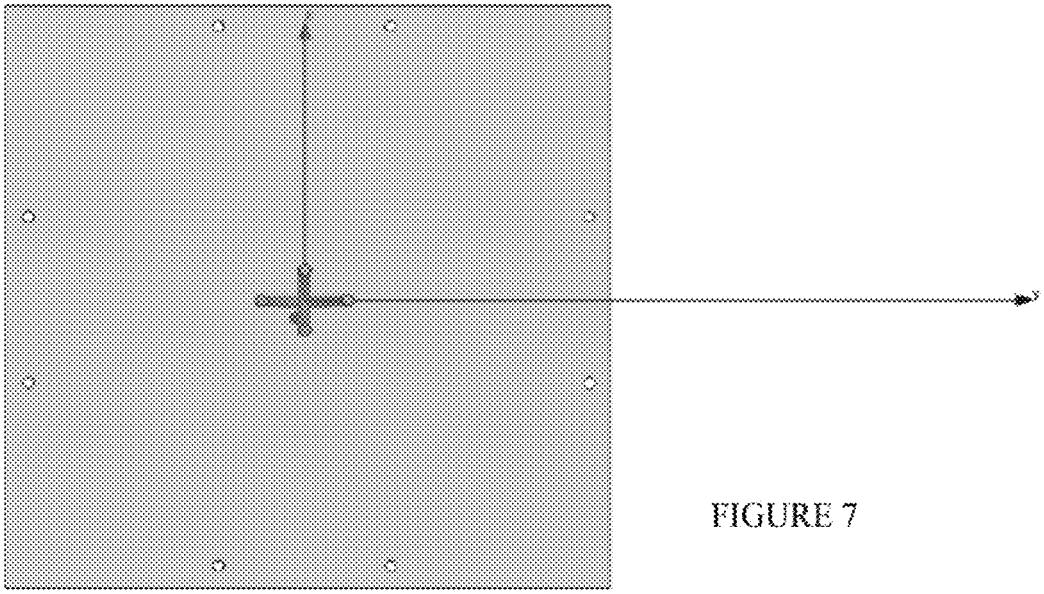
FIG. 7 shows a bottom up view.

FIG. 6 shows a top down view of the antenna 10 and FIG. 7 shows a bottom up view of the antenna 10.

FIG. 8 shows return loss seen at each RF Port (S11 and S22 in dB) as a function of frequency (MHz).

FIG. 9 shows radiation efficiency of antenna as a function of frequency (MHz).

Figure 10:
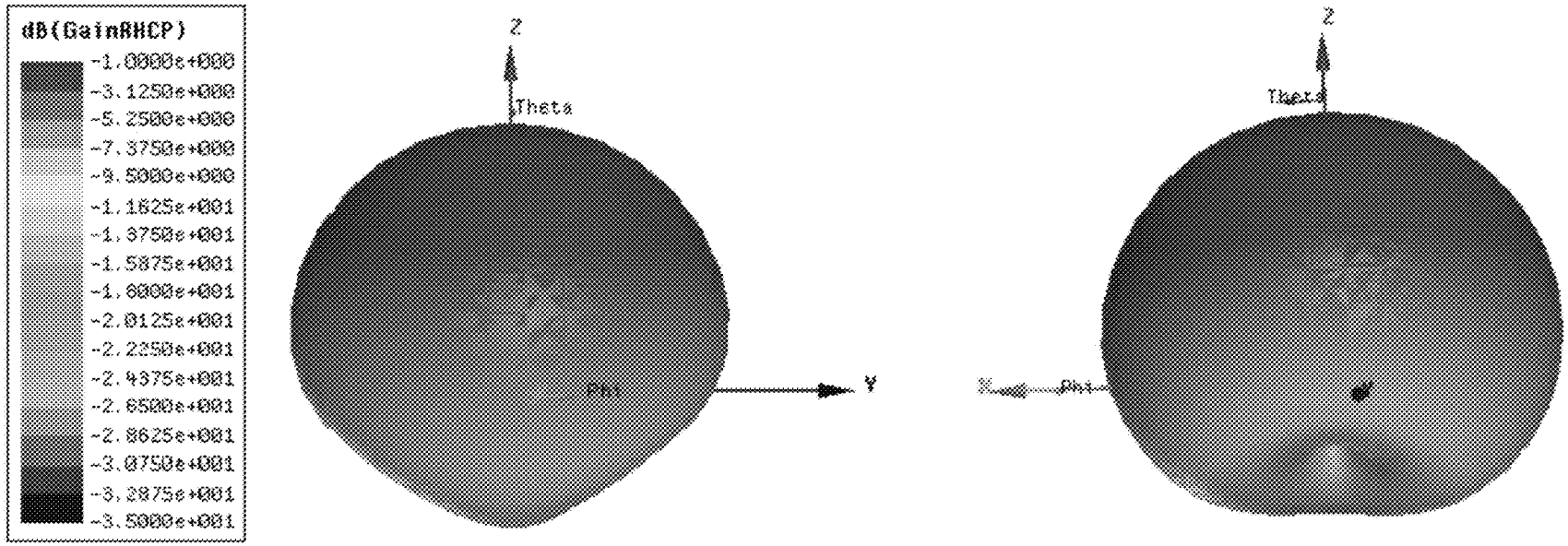
FIG. 10 shows a 3-D radiation pattern of right hand circular polarization pattern at 301.5 MHz (in dB).

FIG. 10 shows a 3-D radiation pattern of right hand circular polarization pattern at 301.5 MHz (in dB).

Figure 11:
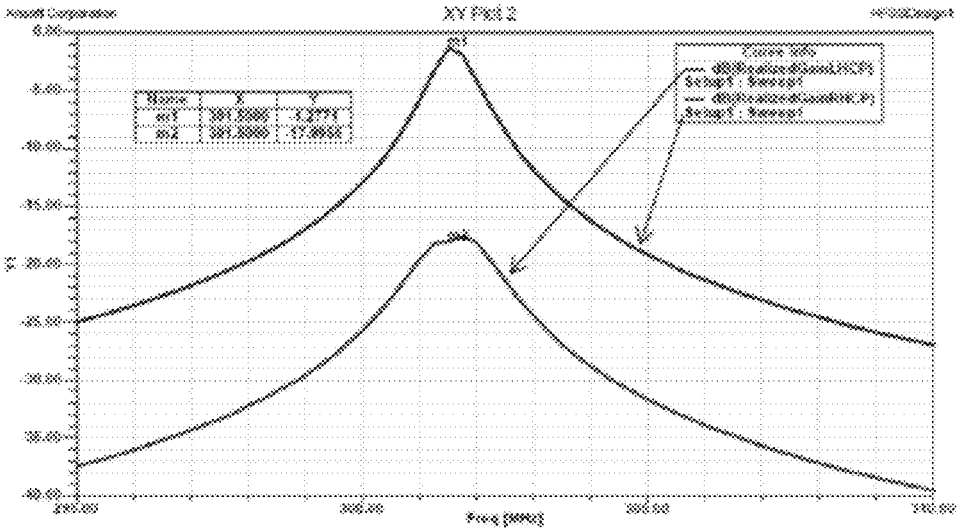
FIG. 11 shows right hand and left hand circular polarization (in dB) at Theta=0 deg, Phi=0 deg as a function of frequency (MHz).

FIG. 11 shows right hand and left hand circular polarization (in dB) at Theta=0 deg, Phi=0 deg as a function of frequency (MHz).

Figure 12:
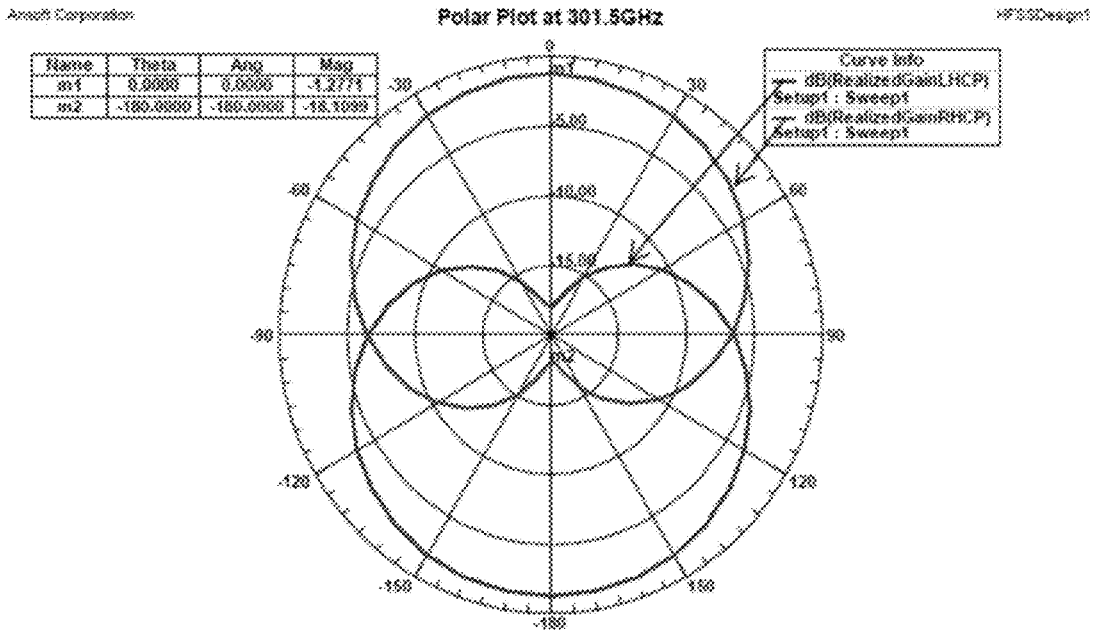
FIG. 12 shows a polar plot of right hand and left hand circular polarization (in dB) at 301.5 MHz.

FIG. 12 shows a polar plot of right hand and left hand circular polarization (in dB) at 301.5 MHz.

One intended use for the invention is to be used as an antenna for portable SATCOM communication devices, in which compactness and portability are a priority.

One major advantage of this invention is the excitation method, i.e., the two crossed copper rings fed in 90 degree out of phase. This feed method allows for the creation of circular polarized fields, as two orthogonal magnetic dipole moments are created at the center of the device.

More specifically, the inclusion of the copper cage structure that surrounds the copper rings allows for an efficient impedance match at the input of the antenna. The feed method results in a significant reduction in the electrical size (ka=0.38), namely in its vertical dimension.

An alternative to the use of the alumina dielectrics may prove advantageous if one considers the influence of near-by structures that may be present in the environment while in use. Since electrically small antenna (ka<0.5) are very susceptible to changes in their performance by near-by conductive structures, the implementation of tunable electronic components are often required to maintain a certain performance level.

A replacement of the alumina dielectrics with variable capacitors (varactor diodes) would allow for the antenna structure to remain impedance matched to its source in the presence of near-by conductive structures. In addition, the inclusion of varactors would allow for a variation in the operational frequency of the antenna, which would provide communication advantages.

A tunable version of the present invention is possible by the inclusion of tunable capacitors (varactors), which allow for the operation of antenna at various frequencies. This tunable embodiment results in minimal variation on the impedance and radiation performance, as can be seen in FIGS. 13-16.

Figure 13:
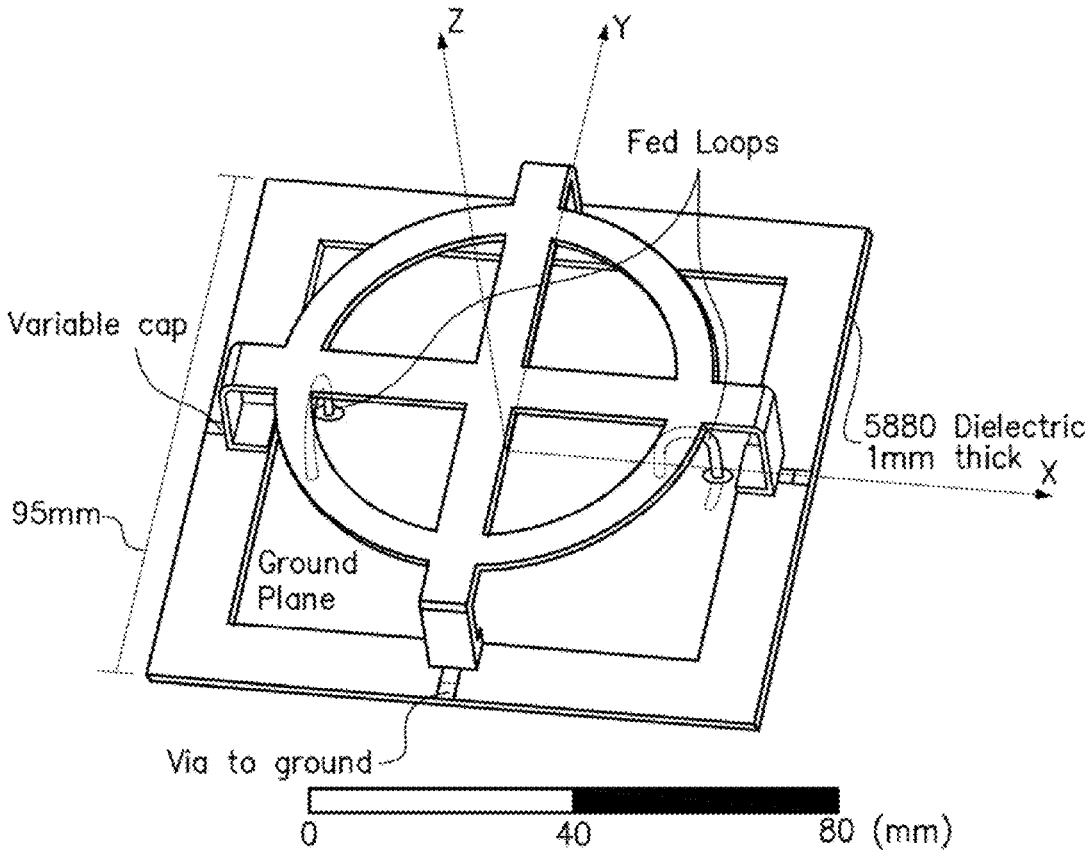
FIG. 13 shows a tunable antenna embodiment with variable capacitors.
Figure 14:
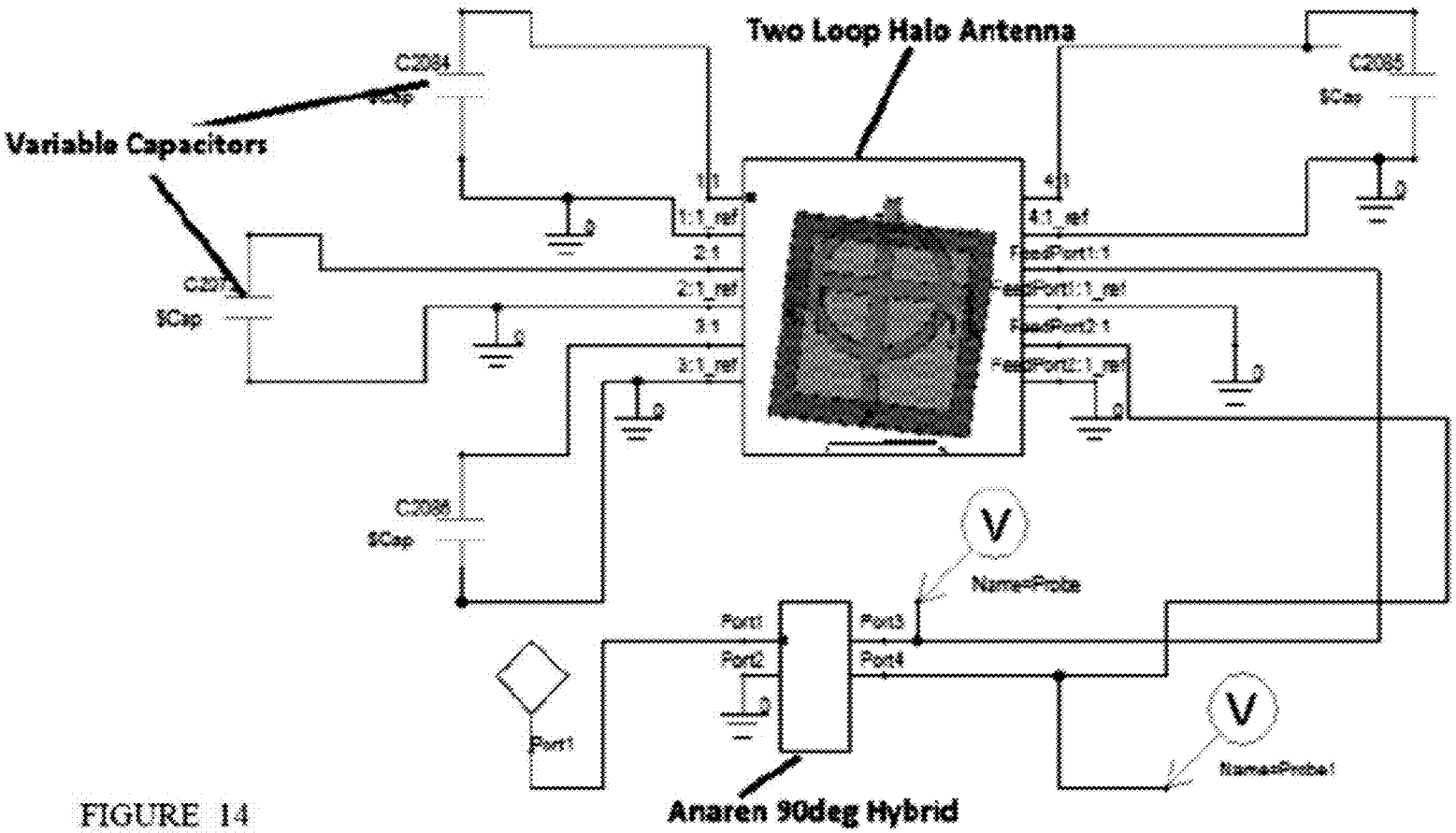
FIG. 14 shows a circuit model with tunable antenna.

FIG. 13 shows an HFSS model of a tunable antenna embodiment with Variable capacitors. FIG. 14 shows an Ansoft designer circuit model with tunable antenna.

Figure 15:
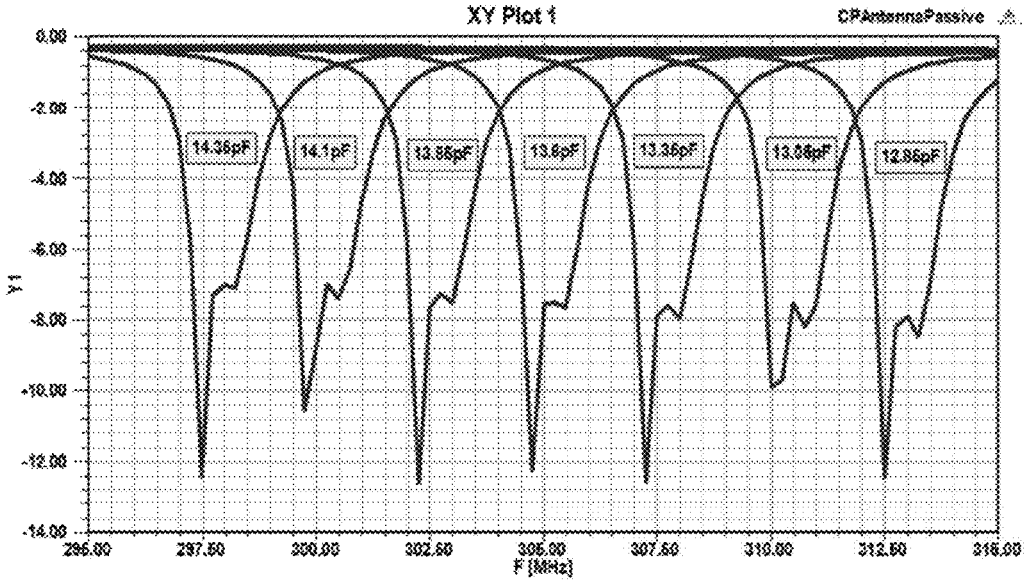
FIG. 15 shows impedance looking into the antenna as a function of variable capacitance.
Figure 16:
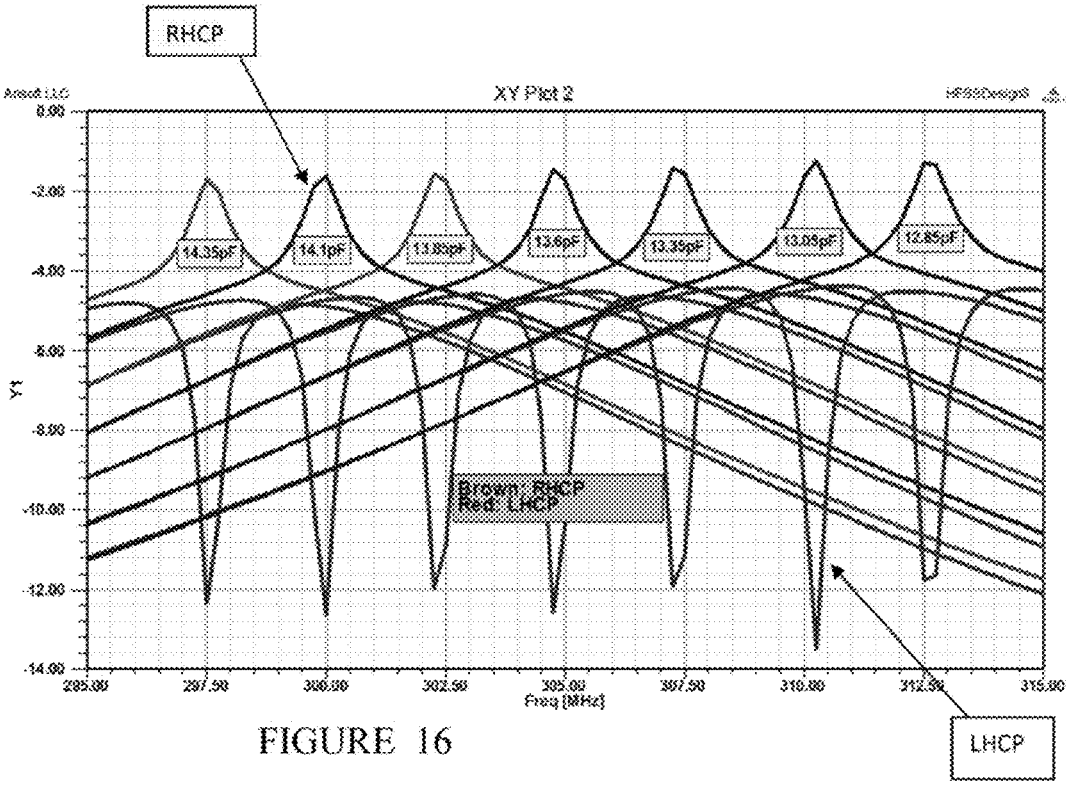
FIG. 16 shows LHCP and RHCP at broadside as a function of variable capacitance.

FIG. 15 shows impedance (S11 dB) looking into the antenna as a function of variable capacitance, and FIG. 16 shows LHCP and RHCP at Broadside as a function of variable capacitance.

The present invention is an efficient electrically small (ka=0.38) circularly polarized antenna for SATCOM communication frequencies (250-300 MHz). The device is composed of two crossed copper half loops which are fed with an RF signal. The two loops require an RF signal of equal amplitude, with a 90 deg. phase difference between the two signals. The half loops are fed from below a conductive ground plane, to which additional RF components can be placed, without detriment to the radiation performance of the device. Components such as 90 degree hybrids couplers, in addition to any active devices like low noise amplifiers (LNA's) could easily fit within the prescribed footprint.

The crossed half loops are encapsulated by a copper cage like structure consisting of four legs which are soldered to dielectric slabs which electrically insulate the cage structure from the copper ground plane. These dielectric slabs act as parallel plate capacitors which create electric field components that effectively cancel the large inductive magnetic field components that are created by the radiating copper half loops.

This mechanism allows for efficient radiation from an electrically small antenna aperture, without the requirement of an external matching network. Thereby because of its small size, this antenna could be used for portable SATCOM communication devices.

The dielectric slabs could be replaced by lumped capacitors both fixed and tunable, to allow for the transmission at various frequencies. The incorporation of tunable capacitors addresses the inherent narrow bandwidth performance of this antenna, which is a consequence of its electrical size. The low cost of the required materials make the design suitable for many applications. An addition the antenna is suitable for high power applications because of its simplicity and the minimization of dielectrics.

In summary the antenna described above has the following advantageous features:

1.) small size, as the ground plane width is 1/12, and the cage height is 1/67 the 2.) operation wavelength at 300 MHz.

3.) high radiation efficiency and gain to that of prior art of similar size.

4.) circular polarized (right or left hand) radiation patterns, which are i. beneficial for SATCOM communications.

5.) Low cost components required for it fabrication.

6.) The potential to adjust the operation frequency by incorporation of tunable i. capacitors.

omni-directional circularly polarized radiation patterns, which allow for i. universal satellite coverage.

From the above description, it is apparent that various techniques may be used for implementing the concepts of the present invention without departing from its scope.

The described embodiments are to be considered in all respects as illustrative and not restrictive. For example, the components are preferably copper. However, other electrically conductive components could the utilized. The ground plane is shown with a square shape. However, other shapes are possible, such a rectangular, round or other shapes, depending on the particular application.

The half loop copper rings are orthogonally crossed relative to each other. Preferably, the crossed rings are orthogonal to the ground plane as well. Also, a single half-loop ring configuration, in lieu of the pair of half-loop configuration, may be suitable in certain applications.

And, a tunable version of the antenna, which incorporates tunable capacitors, may also be suitable in certain applications to provide a tunable operation frequency.

The polarization could be either right hand circular polarization (RCP) or left hand circular polarization (LCP).

Accordingly, it should also be understood that the present invention is not limited to the particular embodiments described herein, but is capable of many embodiments without departing from the scope of the claims.

What is claimed is:

1. An electrically small circularly polarized antenna having a ka coefficient representing electrical size which is less than 0.5, the antenna comprising:

a ground plane;

first and second electrically conductive half-loop rings located at the center of the ground plane, wherein the first and second rings are orthogonally crossed relative to each other and orthogonal to the ground plane;

an RF power source feeding RF power to each of the crossed rings having a 90 degree phase difference relative to each other such that the crossed rings create orthogonal electric fields relative to each other resulting in a circularly polarized total electric field;

an impedance matching circular electrically conductive cage structure located surrounding the crossed rings to allow electric current to circulate around the perimeter of the cage structure wherein the cage structure includes a circular copper ring above the ground plane, the circular ring supported by leg structures which rest on respective dielectric slabs on the ground plane and including a copper cross contained with the circular ring.

2. The antenna of claim 1 wherein the rings are copper.

3. The antenna of claim 2 wherein the first ring crosses over the second ring.

4. The antenna of claim 3 wherein the antenna is impedance matched at the antenna input by creating capacitive fields near the inductive fields generated by the copper rings, to which the combination of inductive and capacitive fields cancel, allowing for efficient radiation of the antenna.

5. The antenna of claim 4 wherein the circular polarization is right handed circular polarization.

6. The antenna of claim 4 wherein the circular polarization is left handed circular polarization.

7. The antenna of claim 3 including tunable varactors to provide tunable operation frequency.

8. The antenna of claim 3 wherein the height of the cage structure above the ground plane allows for compactness.

9. The antenna of claim 8 wherein the ground plane is rectangular in shape.

10. The antenna of claim 8 wherein the ground plane is round in shape.

11. The antenna of claim 8 wherein the ground plane is square in shape.

12. The antenna of claim 11 wherein the height between cage structure and ground plane is approximately 15 mm and the width of the ground plane is approximately 85 mm.

13. An electrically small circularly polarized antenna comprising:

a ground plane;

first and second electrically conductive half-loop rings located at the center of the ground plane, wherein the first and second rings are orthogonally crossed relative to each other;

an RF power source feeding RF power to each of the crossed rings having a 90 degree phase difference relative to each other such that the crossed rings create orthogonal electric fields relative to each other resulting in a circularly polarized total electric field;

an impedance matching circular electrically conductive cage structure located surrounding the crossed rings to allow electric current to circulate around the perimeter of the cage structure, wherein the ka coefficient representing electrical size is less than 0.5 and wherein the rings are orthogonal to the ground plane, the rings are copper, wherein the first ring crosses over the second ring, wherein the height of the cage structure above the ground plane allows for compactness, wherein the ground plane is square in shape, wherein the height between cage structure and ground plane is approximately 15 mm and the width of the ground plane is approximately 85 mm, wherein the cage structure includes a circular copper ring above the ground plane, the circular ring supported by leg structures which rest on respective dielectric slabs on the ground plane, and including a copper cross contained with the circular ring.

14. An electrically small circularly polarized antenna having a ka coefficient representing electrical size which is less than 0.5, the antenna comprising:

a ground plane;

first and second copper half-loop rings located at the center of the ground plane, wherein the first and second rings are orthogonally crossed relative to each other and to the ground plane;

each of the rings including an RF port for receiving RF power to each of the crossed rings having a 90 degree phase difference relative to each other such that the crossed rings create orthogonal electric fields relative to each other resulting in a circularly polarized total electric field;

an impedance matching circular electrically conductive cage structure located above the crossed rings to allow electric current to circulate around the perimeter of the cage structure wherein the cage structure includes a circular copper ring above the ground plane, the circular ring supported by leg structures which rest on respective dielectric slabs on the ground plane and including a copper cross contained with the circular ring.

15. An electrically small circularly polarized antenna comprising:

a ground plane;

first and second copper half-loop rings located at the center of the ground plane, wherein the first and second rings are orthogonally crossed relative to each other and to the ground plane;

each of the rings including an RF port for receiving RF power to each of the crossed rings having a 90 degree phase difference relative to each other such that the crossed rings create orthogonal electric fields relative to each other resulting in a circularly polarized total electric field;

an impedance matching circular electrically conductive cage structure located above the crossed rings to allow electric current to circulate around the perimeter of the cage structure, wherein the ka coefficient representing electrical size is less than 0.5, and wherein the cage structure includes a circular copper ring above the ground plane, the circular ring supported by leg structures which rest on respective dielectric slabs on the ground plane and including a copper cross contained with the circular ring.

* * * * *